US011624153B2

(12) United States Patent
Randolph et al.

(10) Patent No.: US 11,624,153 B2
(45) Date of Patent: Apr. 11, 2023

(54) METHOD OF INCREASING THE THROUGHPUT AND/OR DECREASING ENERGY USAGE OF A PULPING PROCESS

(71) Applicant: BASF SE, Ludwigshafen am Rhein (DE)

(72) Inventors: John Andrew Randolph, Wyandotte, MI (US); Laurence J. Rys, Florham Park, NJ (US); Ferdinand Leifeld, Ludwigshafen (DE); Achim Fessenbecker, Ludwigshafen (DE)

(73) Assignee: BASF SE, Ludwigshafen am Rhein (DE)

( * ) Notice: Subject to any disclaimer, the term of this patent is extended or adjusted under 35 U.S.C. 154(b) by 586 days.

(21) Appl. No.: 16/621,916

(22) PCT Filed: Jun. 12, 2018

(86) PCT No.: PCT/EP2018/065478
§ 371 (c)(1),
(2) Date: Dec. 12, 2019

(87) PCT Pub. No.: WO2018/234097
PCT Pub. Date: Dec. 27, 2018

(65) Prior Publication Data

US 2020/0123707 A1 Apr. 23, 2020

Related U.S. Application Data

(60) Provisional application No. 62/522,387, filed on Jun. 20, 2017.

(51) Int. Cl.
*D21D 1/20* (2006.01)
*D21C 3/22* (2006.01)
(Continued)

(52) U.S. Cl.
CPC ..... *D21C 3/222* (2013.01); *D21C 9/007* (2013.01); *D21D 1/20* (2013.01); *D21B 1/16* (2013.01)

(58) Field of Classification Search
CPC ..... D21D 1/20; D21B 1/16
(Continued)

(56) References Cited

U.S. PATENT DOCUMENTS 4,229,251 A 10/1980 Temler
4,388,148 A 6/1983 Yahrmarkt et al.
(Continued)

FOREIGN PATENT DOCUMENTS

EP 0492600 A1 7/1991
WO 0210507 A1 2/2002
(Continued)

OTHER PUBLICATIONS

International Search Report and Written Opinion for International Patent Application No. PCT/EP2018/065478, dated Aug. 30, 2018, 11 pages.

*Primary Examiner* — Jacob T Minskey
(74) *Attorney, Agent, or Firm* — Armstrong Teasdale LLP

(57) ABSTRACT

A method of increasing the throughput and/or decreasing the energy usage of a pulping process includes the steps of providing a plurality of lignocellulosic chips, providing a refining composition, applying the refining composition to the plurality of lignocellulosic chips, and mechanically refining the plurality of lignocellulosic chips to form pulp. The refining composition includes water and a lubricating additive including the reaction product of a sugar and an alcohol. The step of applying the refining composition to the lignocellulosic chips is conducted less than 5 minutes prior to, or concurrently with, the step of mechanically refining the wood chips to form pulp.

19 Claims, 2 Drawing Sheets

(51) Int. Cl.
*D21C 9/00* (2006.01)
*D21B 1/16* (2006.01)

(58) Field of Classification Search
USPC ..... 162/70
See application file for complete search history.

(56) References Cited

U.S. PATENT DOCUMENTS

| | | | | |
|---|---|---|---|---|
| 6,267,841 | B1 | 7/2001 | Burton | |
| 7,637,271 | B1 | 12/2009 | Cumberland et al. | |
| 2005/0133643 | A1* | 6/2005 | Fernandez | D21B 1/16 241/16 |
| 2010/0224433 | A1 | 9/2010 | Duggirala et al. | |

FOREIGN PATENT DOCUMENTS

| | | | |
|---|---|---|---|
| WO | 2005056916 | A1 | 6/2005 |
| WO | 2012004459 | A1 | 1/2012 |
| WO | 2015036655 | A1 | 3/2015 |

* cited by examiner

METHOD OF INCREASING THE THROUGHPUT AND/OR DECREASING ENERGY USAGE OF A PULPING PROCESS

CROSS-REFERENCE TO RELATED APPLICATIONS

This application is a U.S. National Phase Application of International Patent Application No. PCT/EP2018/065478, filed Jun. 12, 2018, which claims the benefit of priority to U.S. Provisional Patent Application No. 62/522,387, filed Jun. 20, 2017, the entire contents of which are hereby incorporated by reference herein.

FIELD OF THE DISCLOSURE

The present disclosure is generally related to a method of increasing the throughput and/or decreasing the energy usage of a pulping process. The method utilizes a refining composition that includes a particular lubricating additive.

DESCRIPTION OF THE RELATED ART

As is known in the pulping industry, lignocellulosic materials, such as woodchips, are chemically and/or mechanically refined in various pulping processes to produce pulp. The lignocellulosic materials used to produce pulp comprise four primary components, cellulose fibers, lignin (a three-dimensional polymer that binds the cellulose fibers together), hemicelluloses (shorter branched carbohydrate polymers), and water. Pulping processes separate the cellulose fibers within lignocellulosic materials, and the separated cellulose fibers are referred to as pulp. Chemical pulping processes utilize various caustic chemicals to breakdown the lignin and hemicelluloses and separate the cellulose fibers within lignocellulosic materials to form pulp. Mechanical pulping processes mechanically refine, i.e., physically tear apart, the cellulose fibers within lignocellulosic materials to form pulp, which comprises the separated cellulose fibers.

Pulp mills utilize various mechanical pulping processes known in the pulping industry, including stone ground wood (SGW), pressurized ground wood (PGW), refiner mechanical pulp (RMP), pressurized RMP (PRMP), thermo-RMP (TRMP), thermo-mechanical pulp (TMP), thermo-chemi-mechanical pulp (TCMP), thermo-mechanical-chemi pulp (TMCP), long fiber chemi-mechanical pulp (LFCMP), and chemically treated long fiber (CTLF) to produce pulp on pulp production lines. Many modern pulp mills utilize capital intensive continuous pulp production lines which mechanically refine wood chips by grinding them between ridged metal discs called refiner plates. The throughput of pulp production lines can be limited, and mechanical pulping processes require substantial amounts of energy. There remains an opportunity to develop an improved mechanical pulping process.

SUMMARY OF THE DISCLOSURE AND ADVANTAGES

A method of the subject disclosure increases the throughput and/or decreases the energy usage of a pulping process and includes the steps of providing a plurality of lignocellulosic chips, providing a refining composition, applying the refining composition to the plurality of lignocellulosic chips, and mechanically refining the plurality of lignocellulosic chips to form pulp. The refining composition includes water and a lubricating additive comprising the reaction product of a sugar and an alcohol. The step of applying the refining composition to the lignocellulosic chips is conducted less than 5 minutes prior to, or concurrently with, the step of mechanically refining the wood chips to form pulp. Advantageously, the method efficiently produces pulp having desirable chemical and physical properties such as strength, brightness, opacity, freeness, etc.

BRIEF DESCRIPTION OF THE SEVERAL VIEWS OF THE DRAWINGS

Other advantages of the present disclosure will be readily appreciated, as the same becomes better understood by reference to the following detailed description when considered in connection with the accompanying drawings wherein.

DETAILED DESCRIPTION OF THE DISCLOSURE

Figure 1:
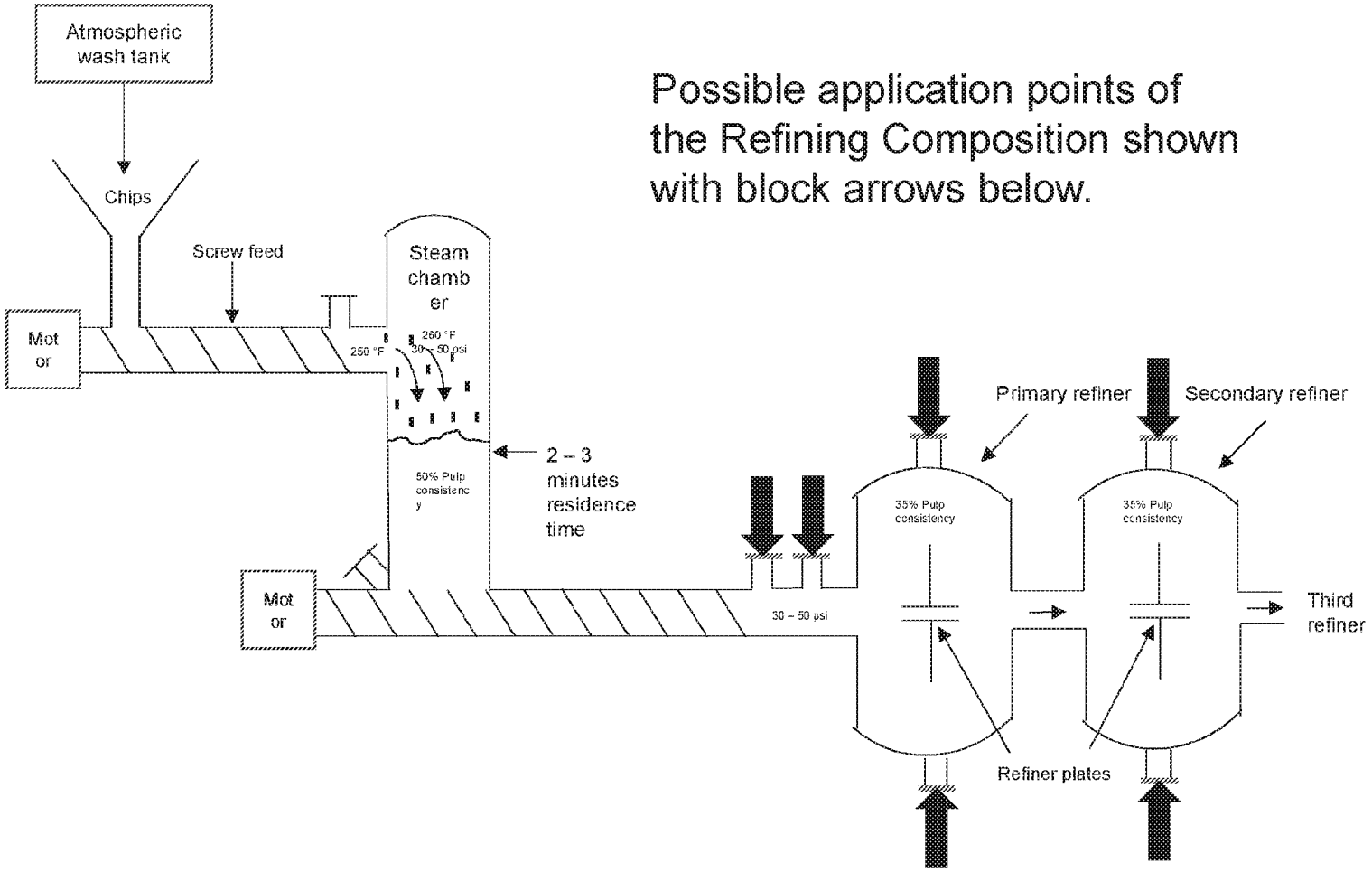
FIG. 1 is a flow chart describing various embodiments of a method of increasing the throughput and/or decreasing the energy usage of a pulping process of this disclosure.

This disclosure provides a method of increasing the throughput and/or decreasing the energy usage of a pulping process. As is described in detail herein, the method includes the steps of providing a plurality of lignocellulosic chips, providing a refining composition, applying the refining composition to the plurality of lignocellulosic chips, and mechanically refining the plurality of lignocellulosic chips to form pulp. The method of this disclosure can be applied to any mechanical pulping process known in the art. The instant method may include one or more steps of such methods relative to the separation and recovery of cellulose, but such steps are not required.

The terminology "lignocellulosic chips" is used to describe chips of lignocellulosic material. Lignocellulosic material is not specifically limited to and may be further defined as, or as including, consisting essentially of (for example, free of non-lignocellulosic material), or consisting of, materials (or precursors thereof) derived from wood, bagasse, straw, flax residue, nut shells, cereal grain hulls, or any material that includes lignin and cellulose, and combinations thereof. In various embodiments, the lignocellulosic material is prepared from various species of hardwoods and/or softwoods, as understood in the art. The lignocellulosic material may be derived from a variety of processes, such as by comminuting logs, industrial wood residue, branches, rough pulpwood, etc. into pieces in the form of sawdust, chips, flakes, wafer, strands, scrim, fibers, sheets, etc. Most typically, the lignocellulosic material is further defined as lignocellulosic chips, woodchips, wood pieces, or wood pulp.

The Refining Composition:

The refining composition includes a lubricating additive comprising the reaction product of a sugar and an alcohol, and water.

I. The Lubricating Additive:

The lubricating additive is produced by reacting a monosaccharide, or a compound hydrolysable to a monosaccharide, with an alcohol such as a fatty alcohol in an acid medium.

The sugar has the formula: $[C_6H_{12}O_6]_{n+1}$, wherein n is an average value of zero or greater. In various embodiments, n is an average value of 0, 1, 2, 3, 4, 5, 6, 7, or 8. In various embodiments, n is an average value from 0 to 8, 1 to 7, 1 to 3, 1 to 2, 2 to 6, 3 to 5, or 4 to 5. In various embodiments, n+1 has a value of from 1 to 3, 1 to 2.5, 1 to 2, 1.5 to 3, 1.5 to 2.5, 1.5 to 2, 1.2 to 2.5, 1.1 to 1.9, 1.2 to 1.8, 1.3 to 1.7, 1.4 to 1.6, 1.4 to 1.8, or 1.5. In other embodiments, n+1 is an average value of 1.1, 1.2, 1.3, 1.4, 1.5, 1.6, 1.7, 1.8, 1.9, or 2.

Any sugar having the aforementioned formula or any isomer thereof may be utilized. For example, the sugar may be an aldohexose, or a ketohexose. In various embodiments, the sugar is chosen from allose, altrose, galactose, glucose, gulose, idose, mannose, talose, and combinations thereof. In other embodiments, the sugar is chosen from fructose, psicose, sorbose, tagatose, and combinations thereof. In even further embodiments, the sugar is chosen from glucose, fructose and galactose. In further embodiments, the sugar is glucose, or fructose, or galactose. The sugar may be any one or more of the aforementioned sugars, each having the formula, $C_6H_{12}O_6$. Moreover, the sugar may be any one or more complexes of the aforementioned sugars when n is greater than zero. These complexes may be alternatively described as carbohydrates.

Typically, the lubricating additive is formed from glucose, i.e., includes glucose as its building block. It is contemplated that any known isomer or anomer of glucose may be used. For example, glucose has four optic centers, such that glucose can have 15 optical stereoisomers, any of which may be utilized.

The alkyl alcohol has the formula: ROH, wherein R is an alkyl group having from 1 to 20 carbon atoms. The alkyl group may have any number of carbon atoms from 1 to 20 or any value or range of values therebetween. In various embodiments, R is an alkyl group having 8, 9, 10, 11, 12, 13, 14, 15, or 16 carbon atoms. In other embodiments, R is an alkyl group having 8 to 12 carbon atoms. In further embodiments, R is an alkyl group having 8 to 14 carbon atoms. In still further embodiments, R is an alkyl group having 8 to 16 carbon atoms. The alkyl group may be linear, branched, or cyclic. In various embodiments, the alkyl group is further defined as an alkenyl group having one or more C=C double bonds. The one or more C=C double bonds may be present at any point in the alkenyl group.

In one particular embodiment, the alkyl alcohol is further defined as comprising a first alkyl alcohol having the formula: ROH wherein R is an alkyl group having 1 to 20 carbon atoms and a second, different alkyl alcohol having the formula: R' OH, wherein R' is independently an alkyl group having 1 to 20 carbon atoms. Each of R and R' may be any value described above. In various embodiments, R and/or R' is each independently 8, 10, 12, 14, or 16. In other embodiments, R and/or R' is each independently 9, 11, 13, 15, or 17. Moreover, all values and ranges of values including and between those described above are hereby expressly contemplated for use in non-limiting embodiments.

The alkyl alcohol and the sugar are combined to form a lubricating additive having the formula: $[C_6H_{12}O_6][C_6H_{11}O_S]_nOR$. Each portion of the formula may be any isomer of $C_6H_{12}O_6$. In other words, any structure or form of $C_6H_{12}O_6$ may be used in either portion of the aforementioned formula. The "first" $[C_6H_{12}O_6]$ may be a different isomer than the "second" $[C_6H_{12}O_6]$ of the aforementioned formula. In various additional non-limiting embodiments, all values and ranges of values between and including the aforementioned values are hereby expressly contemplated.

In addition, R may be any alkyl group, linear, branched, cyclic, etc. that has from 1 to 20 carbon atoms. In other words, R may have 1, 2, 3, 4, 5, 6, 7, 8, 9, 10, 11, 12, 13, 14, 15, 16, 17, 18, 19, or 20, carbon atoms. In various embodiments, R has 2 to 19, 3 to 18, 4 to 17, 5 to 16, 6 to 15, 7 to 14, 8 to 12, 8 to 13, 8 to 14, 9 to 10, 10 to 11, 10 to 12, 8 to 12, 8 to 10, 8 to 14, 10 to 14, 10 to 12, 6 to 14, 6, to 12, 6 to 8, 6 to 10, or 6 to 12, carbon atoms. In one embodiment, R is linear and has 10 carbon atoms. In other embodiments, R is C8-C10, C10-C12, C12-C14, C8, C10, C12, C14, or C16, or any combination thereof. In this formula, n is an average value or number of zero or greater. In various additional non-limiting embodiments, all values and ranges of values between and including the aforementioned values are hereby expressly contemplated.

In various embodiments, the lubricating additive can be generally described as having the structure:

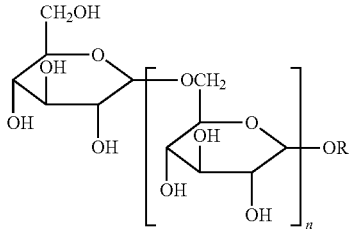

wherein n is as described above.

In other embodiments, n is 1 or greater. In various embodiments, the average of n+1 is the degree of polymerization of the lubricating additive and is from 1.2 to 2.5, 1.3 to 1.7, or 1.5 to 1.7. In various embodiments, the average of n+1 is 1.2, 1.3, 1.4, 1.5, 1.6, 1.7, 1.8, 1.9, 2, 2.1, 2.2, 2.3, 2.4, or 2.5. In various additional non-limiting embodiments, all values and ranges of values between and including the aforementioned values are hereby expressly contemplated.

In further embodiments, the lubricating additive has the structure:

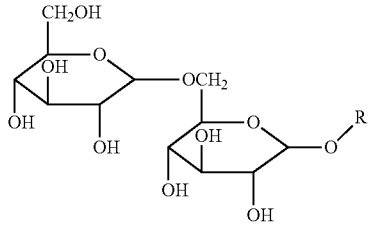

wherein R may be any as described above, e.g. C8-C14 or any therebetween.

Suitable examples of commercially available lubricating additives include, but are not limited to, DISPONIL® and Glucopon® products commercially available from BASF Corp.

From a compatibility perspective, the lubricating additive is soluble in alkaline, sulfite, and certain acidic solutions. As such, refining compositions can utilize the lubricating additive with a wide range of other components.

Further, the lubricating additive is tolerant to electrolytes like sodium hydroxide and sodium sulfite in solution. As such, refining compositions comprising the lubricating additive are particularly stable, and effective in the presence of electrolytes.

In mechanical pulping processes, the lubricating additive quickly wets out the lignocellulosic chips, and effectively reduces the energy consumption required to refine lignocellulosic chips without negatively impacting products formed with the pulp produced. More specifically, the lubricating additive does not impact key properties of the pulp and the products formed therefrom.

In various embodiments, the lubricating additive is present in the refining composition in an amount of less than 10, 9, 8, 7, 6, 5, 4, 3, 2, 1, 0.5, 0.4, 0.3, 0.2, wt. % based on the total weight of the plurality of lignocellulosic chips. In other embodiments, the lubricating additive is present in an amount of from 0.01 to 10, 0.2 to 10, 0.5 to 8, or 1 to 5, wt. % based on the total weight of the plurality of lignocellulosic chips. It is contemplated that one or more of the aforementioned values may be any value or range of values, both whole and fractional, within the aforementioned ranges and/or may vary by ±5%, ±10%, ±15%, ±20%, ±25%, ±30%, etc.

II. Water:

The refining composition also includes water. The water is not particularly limited in type or purity and may include distilled water, well water, tap water, etc. In addition, the amount of water present in the refining composition is also not particularly limited. In various embodiments, the water is present in the refining composition in an amount of greater than 5, 10, 15, 20, 25, 30, 35, 40, 45, 50, 55, 60, 65, 70, 75, 80, 85, 90, 91, 92, 93, 94, 95, 96, 97, 98, or 99, wt. % based on a total weight of the refining composition. In other embodiments, the water is present in an amount of from 50 to 99.5, 80 to 99.5, 90 to 99, or 95 to 99, wt. % based on a total weight of the refining composition. It is contemplated that one or more of the aforementioned values may be any value or range of values, both whole and fractional, within the aforementioned ranges and/or may vary by ±5%, ±10%, ±15%, ±20%, ±25%, ±30%, etc.

III. Additional Additive(s):

In addition to the lubricating additive and water, the refining composition may include one or more additional additives including, but not limited to, corrosion inhibitors, surfactants, pH adjusters, thickeners, stabilizers, odorants, colorants, and combinations thereof. If included, the additives may be included in the composition in various amounts. In some embodiments, the additives included may be non-ionic, anionic, or cationic.

In some embodiments, the refining composition may include a corrosion inhibitor. The corrosion inhibitor may be defined, in general terms, as a substance that, when added, reduces the corrosion rate of a metal exposed to the various materials of the ethanol process. To this end, the corrosion inhibitor is useful for inhibiting corrosion of the surface of the equipment used in the process. The process can include any corrosion inhibitor known in the art. Of course, the refining composition can include more than one corrosion inhibitor, i.e., a combination of different corrosion inhibitors. In one embodiment, the corrosion inhibitor includes an amphoteric surfactant. As such, the corrosion inhibitor may be the amphoteric surfactant or may include one or more additional components, such as water. If the corrosion inhibitor includes water, the amphoteric surfactant can be provided in various concentrations. Suitable amphoteric surfactants, for purposes of the present disclosure, include betaines, imidazolines, and propionates. Further examples of suitable amphoteric surfactants include sultaines, amphopropionates, amphodipropionates, aminopropionates, aminodipropionates, amphoacetates, amphodiacetates, and amphohydroxypropylsulfonates. In certain embodiments, the amphoteric surfactant is at least one of a propionate or an amphodiacetate. Further specific examples of suitable amphoteric surfactants include N-acylamino acids such as N-alkylaminoacetates and disodium cocoamphodiacetate, and amine oxides such as stearamine oxide. In one embodiment, the amphoteric surfactant includes disodium cocoamphodiacetate.

In some embodiments, the refining composition may include a surfactant. The surfactant is typically selected from the group of nonionic surfactants, anionic surfactants, and ionic surfactants. Suitable amphoteric surfactants, for purposes of the present disclosure, include polyalkyleneoxide, alkylpolyalkyleneoxide, polyoxyethylene sorbitan monolaurate, alkylpolyglucosides, anionic derivatives of alkylpolyglucosides, fatty alcohols, anionic derivatives of fatty alcohols, and phosphate esters.

However, in other embodiments, the refining composition consists of, or consists essentially of, the lubricating additive and the water. Embodiments where the refining composition consists essentially of the lubricating additive and the water are free of any additional additives or other components which would materially affect the basic and novel characteristics of the claimed invention.

In some embodiments, the composition is free of additives, including but not limited, to surfactants, corrosion inhibitors, chelating agents, polymers, acrylic polymers, acids, bases, alcohols, and/or polyols. In yet other embodiments, the refining composition is free of surfactants, corrosion inhibitors, chelating agents, polymers, acrylic polymers, acids, bases, alcohols, and/or polyols. The term "free of" as used herein with respect to a component which can be included in the refining composition can be defined as including less than 0.5, or less than 0.1, or less than 0.01, or including 0, wt. % of the component based on a total weight of the refining composition.

IV. Properties of the Refining Composition:

The refining composition is effective at a neutral pH and is thus not caustic in nature. In many embodiments, the refining composition has a pH of from 1.5 to 12, 4 to 10, 5 to 9, 6 to 8, or 6.5 to 7.5. In various non-limiting embodiments, all values and ranges of values between the aforementioned values are hereby expressly contemplated.

In some embodiments, the refining composition has a Draves Wetting Time of less than 100 seconds determined using ASTM D2281. In various embodiments, the refining composition has a Draves Wetting Time of less than 95, 90, 85, 80, 75, 70, 65, 60, 55, 50, 45, 40, 35, 30, 25, 20, 15, 10, or 5, seconds, as determined using ASTM D2281, or any range or ranges thereof, including any and all fractional values and ranges of fractional values within those described above. In other embodiments, the refining composition has a Draves Wetting Time of from 1 to 20, 2 to 18, 3 to 17, 4 to 16, 5 to 15, 6 to 14, 7 to 13, 8 to 12, 9 to 11, or 10 to 11, seconds, as determined using ASTM D2281. The Draves Wetting Time of less than 100 seconds indicates that the branched digestion additive effectively wets the lignocellulosic material such that the water and the refining composition can interact with, and penetrate, the lignocellulosic material. In various embodiments, it is expressly contemplated that the refining composition may have any Draves wetting time, or ranges of times, both whole and fractional, from 0 up to 100 seconds.

The Method:

The method of this disclosure increases the throughput and/or decreases the energy usage of a pulping process. In the pulping process, the lignocellulosic chips are mechanically refined to produce pulp. The lignocellulosic chips include four primary components, cellulose fibers, lignin (a three-dimensional polymer that binds the cellulose fibers together), hemicelluloses (shorter branched carbohydrate polymers), and water. The pulping process refines, i.e., physically tears apart, the cellulose fibers within lignocellulosic chips to form pulp, which includes the separated cellulose fibers.

As set forth above, the method of this disclosure includes the step of providing the lignocellulosic chips. The step of providing is not particularly limited and may include delivering, supplying, etc. In various embodiments, the step of providing may be further defined as supplying the lignocellulosic chips in one or more forms as described above by grinding, chipping, pulverizing, comminuting, shredding, and cutting the lignocellulosic material or a precursor thereof. In one embodiment, lignocellulosic material includes, consists essentially of, or consists of lignocellulosic chips, e.g. wood chips.

The method of this disclosure also includes the step of providing the refining composition. The refining composition is just as described above. The step of providing is not particularly limited and may include delivering, supplying, etc. In various embodiments, the step of providing may be further defined as supplying the refining composition in one or more forms, e.g. as a concentrate to be diluted.

In some embodiments, the lubricating additive is provided neat and is then diluted with a solvent, e.g. water, to form the lubricating composition prior to the step of applying the refining composition to the lignocellulosic chips.

It is also contemplated herein that the refining composition can be supplied in two or more discreet components, which can be blended together prior to use. For example, the refining composition can be supplied in a two component system, with one component comprising the lubricating additive, and the other component comprising water and other additives. In this example, the two components can be provided separately and blended together on site at the location of use just prior to use and, if desired, diluted with water.

The method of this disclosure includes the step of applying the refining composition to the plurality of lignocellulosic chips. In some embodiments, the refining composition is applied to the plurality of lignocellulosic chips at a temperature of from 5 to 99, 5 to 85, 5 to 45, or 15 to 35° C. In various non-limiting embodiments, all values and ranges of values between the aforementioned values are hereby expressly contemplated.

The refining composition is applied to the plurality of lignocellulosic chips. In some embodiments, the refining composition is applied in an amount of from 0.5 to 125, 5 to 100, or 10 to 80, wt. % based on the total weight of the plurality of lignocellulosic chips. Alternatively, the refining composition is applied in an amount such that the lubricating additive is present in an amount of from 0.01 to 10, 0.01 to 5, 0.01 to 2.0, 0.01 to 1.0, 0.1 to 0.7, or 0.1 to 0.5, wt. % based on a total weight of a plurality of lignocellulosic chips being refined. In various non-limiting embodiments, all values and ranges of values between the aforementioned values are hereby expressly contemplated.

The method of this disclosure includes the step of mechanically refining the plurality of lignocellulosic chips to form pulp. During the step of mechanically refining the plurality of lignocellulosic chips the cellulose fibers within lignocellulosic chips are torn apart to form pulp, which includes the separated cellulose fibers. In a typical embodiment, the step of mechanically refining the plurality of lignocellulosic chips is conducted in a refiner which mechanically refines the cellulosic chips by grinding them between ridged metal discs called refiner plates.

In various embodiments, the step of mechanically refining the plurality of lignocellulosic chips to form pulp is conducted on one or more refiners, e.g. any combination of a primary, secondary, and a tertiary refiner. In one example an embodiment of the method includes the single step of mechanically refining the plurality of lignocellulosic chips to form pulp on a refiner. In another example, an embodiment of the method includes the steps of mechanically refining the plurality of lignocellulosic chips on a primary refiner, and then further mechanically refining the plurality of lignocellulosic chips on a secondary refiner. In yet another example, an embodiment of the method includes the steps of mechanically refining the plurality of lignocellulosic chips on a primary refiner, further mechanically refining the plurality of lignocellulosic chips on a secondary refiner, and furthermore mechanically refining the plurality of lignocellulosic chips on a tertiary refiner. FIG. 1 is a flow chart describing various embodiments of a method of increasing the throughput and/or decreasing the energy usage of a pulping process of this disclosure which utilizes a primary, secondary, and tertiary refiner.

The refining composition increases the throughput and/or decreases the energy usage during the step of mechanically refining the plurality of lignocellulosic chips to form pulp. Advantageously, the lignocellulosic chips do not need to be soaked in the refining composition. The refining composition decreases the amount of energy required during refining with very little dwell time on the lignocellulosic chips. To this end, in the method of this disclosure, the step of applying the refining composition to the lignocellulosic chips is conducted less than 5 minutes prior to, or concurrently with, the step of mechanically refining the wood chips to form pulp. In some embodiments, the step of applying the refining composition to the plurality of lignocellulosic chips is conducted no greater than 4, no greater than 3, no greater than 2, and no greater than 1, minute(s) prior to the step of mechanically refining the wood chips to form pulp.

In many embodiments, the step of applying the refining composition to the plurality of lignocellulosic chips is conducted simultaneous with the step of mechanically refining the wood chips to form pulp.

In many embodiments, the step of applying the refining composition to the plurality of lignocellulosic chips includes one or more sub-steps, or applications of the refining composition. For example, in one embodiment of the method, 5 to 100, or 25 to 100, wt. % of the total amount of refining composition is applied to the plurality of lignocellulosic chips in the primary refiner during the step of mechanically refining the plurality of lignocellulosic chips. In some embodiments, all or a portion of the refining composition is applied to the plurality of lignocellulosic chips in the primary, secondary, and/or tertiary refiners. In various non-limiting embodiments, all values and ranges of values between the aforementioned values are hereby expressly contemplated, e.g. portions of the application of the refining composition applied in the primary, secondary, and tertiary refiners.

In some embodiments, the method is further defined as a continuous process wherein the step of mechanically refining the plurality of lignocellulosic chips to form pulp is conducted at a rate of from 1 kg/hr to 1000 ton/hr, 50 kg/hr to 700 ton/hr, 500 kg/hr to 500 ton/hr, or 1 ton/hr to 300 ton/hr. In various non-limiting embodiments, all values and ranges of values between the aforementioned values are hereby expressly contemplated.

In many embodiments of the method, an energy usage during the step of refining is at least 5, at least 6, at least 7, at least 8, at least 9, at least 10, at least 11, at least 12, at least 13, at least 14, at least 15, at least 16, at least 17, at least 18, at least 19, at least 20, at least 25, at least 30, at least 35, at least 40, at least 45, percent less than a comparable energy usage during the step of refining of a comparable method which does not utilize the claimed lubricating additive. Alternatively, in some embodiments of the method, an energy usage during the step of refining is from 1 to 50, 5 to 50, 5 to 40, 5 to 30, 5 to 20, 10 to 20, or 8 to 16, percent less than a comparable energy usage during the step of refining of a comparable method which does not utilize the claimed lubricating additive during the step of refining.

In many embodiments of the method, an energy usage during the step of refining is at least 5, at least 6, at least 7, at least 8, at least 9, at least 10, at least 11, at least 12, at least 13, at least 14, at least 15, at least 16, at least 17, at least 18, at least 19, at least 20, at least 25, at least 30, at least 35, at least 40, or at least 45, percent less than a comparable energy usage during the step of refining of a comparable method which does not utilize any surfactant or lubricating additive. Alternatively, in some embodiments of the method, an energy usage during the step of refining is from 1 to 50, 5 to 50, 5 to 40, 5 to 30, 5 to 20, 10 to 20, or 8 to 16, percent less than a comparable energy usage during the step of refining of a comparable method which does not utilize any surfactant or lubricating additive during the step of refining.

In many embodiments of the method, a throughput is at least 1, at least 5, at least 6, at least 7, at least 8, at least 9, at least 10, at least 11, at least 12, at least 13, at least 14, at least 15, at least 16, at least 17, at least 18, at least 19, or at least 20, percent more than a comparative throughput of a comparable method which does not utilize the claimed lubricating additive, when an energy usage during the step of refining is equal to or less than the comparable energy usage during the step of refining of the comparable method which does not utilize the claimed lubricating additive during the step of refining. Alternatively, in some embodiments of the method, a throughput is from 1 to 20, 5 to 20, 10 to 20, or 8 to 16, percent more than a comparative throughput of a comparable method which does not utilize the claimed lubricating additive, when an energy usage during the step of refining is equal to or less than the comparable energy usage during the step of refining of the comparable method which does not utilize the claimed lubricating additive during the step of refining.

In many embodiments of the method, a throughput is at least 1, least 5, at least 6, at least 7, at least 8, at least 9, at least 10, at least 11, at least 12, at least 13, at least 14, at least 15, at least 16, at least 17, at least 18, at least 19, or at least 20, percent more than a comparative throughput of a comparable method which does not utilize a surfactant or lubricating additive, when an energy usage during the step of refining is equal to or less than the comparable energy usage during the step of refining of the comparable method which does not utilize any surfactant or lubricating additive during the step of refining. Alternatively, in some embodiments of the method, a throughput is from 1 to 20, 5 to 20, 10 to 20, or 8 to 16, percent more than a comparative throughput of a comparable method which does not utilize any surfactant or lubricating additive, when an energy usage during the step of refining is equal to or less than the comparable energy usage during the step of refining of the comparable method which does not utilize any surfactant or claimed lubricating additive during the step of refining.

As is set forth above, pulp mills utilize mechanical pulping processes which are, problematically, energy intensive. As such, there is a need for solutions, such as the subject method, which either increase throughput of the mechanical pulping without increasing the energy usage, or reduce energy usage of such mechanical pulping processes at a standard throughput. Of course, such solutions should not compromise pulp quality. Without being bound by theory, it is believed that the lubricating additive lowers the surface tension of the water of the refining composition and allows the water to better penetrate the plurality of lignocellulosic chips resulting in greater water uptake which "swells" and softens the plurality of lignocellulosic chips allowing for refining with reduced energy, which does not impact pulp quality (or the quality of the paper formed from the pulp).

In many embodiments of the method, the pulp produced with the method of this disclosure has a degree of fibrillation as measured according to Canadian Standard Freeness ("CSF") of from 50 to 800, 75 to 600, or 100 to 300. Alternatively, the pulp produced with the method of this disclosure has a CSF of about ±5, of about ±10, of about ±15, of about ±20, of about ±25% of the degree of fibrillation of pulp produced via a comparable method which does not utilize the claimed lubricating additive. In additional non-limiting embodiments, all values and ranges of values within and including the aforementioned range endpoints are hereby expressly contemplated.

CSF is an empirical test procedure that measures the rate at which 3 grams of a fibrous pulp material in 1 liter of water may be drained. CSF measurements are conducted in accordance with the TAPPI T227 test procedure. In making CSF measurements, it is noted that a more fibrillated fibrous pulp material will have a lower water drainage rate and, thus, a lower "ml CSF" value, and that a less fibrillated fibrous pulp material will have a higher "ml CSF" value.

In many embodiments of the method, the pulp produced with the method of this disclosure has a wet tensile strength of from 100 to 8,000, 600 to 6,000, or 1,200 to 4,000, N/m when tested in accordance with TAPPI T494.

The following examples, illustrating the composition and method of the present disclosure, are intended to illustrate and not to limit the disclosure.

EXAMPLES

Example 1: Water Uptake

A series of refining compositions comprising the lubricating additive of Example 1 are formed in accordance with this disclosure. Two series of comparative refining compositions are also formed but do not represent this disclosure.

A 1-500 g sample of spruce cubes (lignocellulosic chips) are submerged in each of the refining compositions to form a mixture, and the mixture is agitated for 30 minutes at 90° C. Each sample of spruce cubes is separated from the refining compositions and reweighed. A weight percent increase in the sample of spruce cubes is measured and recorded in the bar chart of FIG. 2. The details regarding the refining compositions of Example 1 and Comparative Examples 1 and 2 are set forth immediately below.

Figure 2:
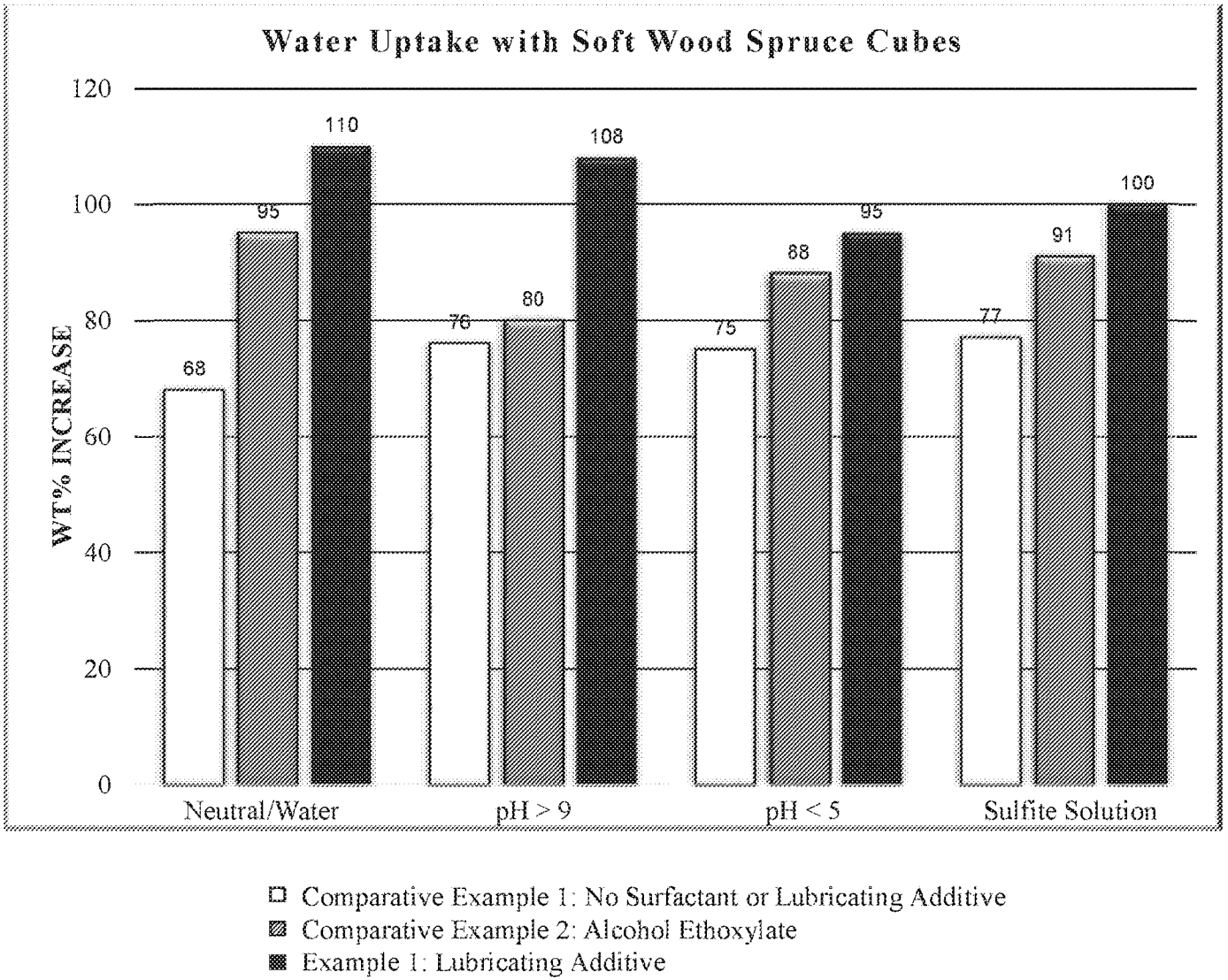
FIG. 2 is a bar graph showing the water uptake of a plurality of lignocellulosic chips having the lubricating composition of the subject disclosure applied thereto.

Referring now to FIG. 2, a refining composition comprising water, a refining composition comprising water with a neutral pH (7), a refining composition comprising water with an alkaline pH (12), a refining composition comprising water with an acidic pH (1.5), and a refining composition comprising a sulfite solution, are formed with the lubricating additive of Example 1 and shown in black. The lubricating additive of Example 1 includes the reaction product of a sugar having the formula: $[C_6H_{12}O_6]_{n+}$, wherein n is an average value of between 1 and 2 and an alkyl alcohol having the formula: ROH, wherein R is an alkyl group having 8 to 10 carbon atoms.

Still referring to FIG. 2, a series of comparative refining compositions without any surfactant or lubricating additive are formed comprising water (pH 7), water with an alkaline pH (12), water with an acidic pH (1.5), and sulfite solution are formed and referred to as Comparative Example 1 and shown in white. These refining compositions are essentially control compositions which do not include any surfactant or lubricating additive.

Still referring to FIG. 2, a refining composition in water, a refining composition in water with a neutral pH (7), a refining composition in water with an alkaline pH (12), a refining composition with an acidic pH (1.5), and a refining composition in a sulfite solution, are formed with the alcohol ethoxylate surfactant of Comparative Example 2 and shown in grey.

The refining compositions of Example 1 accelerate the water uptake of the samples of spruce cubes as is shown in FIG. 2 in comparison to Comparative Examples 1 and 2. Further, the lubricating additive of Example 1 performs well over a wide range of conditions, e.g. acidic, basic, neutral, etc. The lubricating additive of Example 1 lowers the surface tension of the water of the refining compositions and allows the water to better penetrate the plurality of spruce cubes, resulting in greater water uptake which swells and softens the spruce cubes.

Example 2: Increased Throughput and/or Decreased Energy Usage

A refining compositions comprising water and a lubricating additive is utilized in the method of Example 2. The method of Example 2 is in accordance with the subject disclosure. The lubricating additive of the method of Example 1 includes the reaction product of a sugar having the formula: $[C_6H_{12}O_6]_{n+1}$, wherein n is an average value of between 1 and 2 and an alkyl alcohol having the formula: ROH, wherein R is an alkyl group having 8 to 10 carbon atoms.

The refining composition of Example 1 is introduced to a continuous mechanical refining process having a primary, secondary, and tertiary refiner. The refining composition is added to the primary refiner in an amount such that 0.4 wt. % of the lubricating additive is added based on a total weight of the lignocellulosic chips being refined. The results of the experiment are set forth in Table 1 below.

TABLE 1

| Sample # | Time | Refiner Energy, KW/hr. | Energy, % | Freeness (TAPPI T227) | Brightness (TAPPI T452) | Tensile Strength (TAPPI T494) | Bond (TAPPI T569) |
|---|---|---|---|---|---|---|---|
| 1 | 7:00 | Primary | 100% | 237 | 59.8 | 1645 | 28 |
| Control - | AM | refiner: | | | | | |
| before addition | | 2200 KW | | | | | |
| of Refining | | Secondary | 100% | | | | |
| Composition of | | refiner: | | | | | |
| Example 2 | | 2300 KW | | | | | |
| Start addition of Refining Composition of Example 2 @ 0.4% based on a total weight of a plurality of lignocellulosic chips. | | | | | | | |
| Decrease energy to 79% and 74% | | | | | | | |
| 2 | 8:30 | 1738 KW | 79% | 310 | — | — | — |
| | AM | 1702 KW | 74% | | | | |
| 1 hour later | | | | | | | |
| 3 | 9:30 | 1738 KW | 79% | 312 | 59.2 | 1180 | 22 |
| | AM | 1702 KW | 74% | | | | |
| 2.5 hours later | | | | | | | |
| 4 | 11:00 | 1782 KW | 81% | 274 | 60.2 | 1535 | 25 |
| | AM | 1909 KW | 83% | | | | |
| 3.5 hour later | | | | | | | |
| 5 | NOON | 1782 KW | 81% | 275 | — | — | — |
| | | 1909 KW | 83% | | | | |
| 5 hours later | | | | | | | |
| Decrease energy to 84% and 85% | | | | | | | |
| 6 | 1:30 | 1848 KW | 84% | 255 | | | |
| | PM | 1955 KW | 85% | | | | |
| 6.5 hours later | | | | | | | |
| 7 | 3:00 | 1848 KW | 84% | 247 | — | — | — |
| | PM | 1955 KW | 85% | | | | |
| 8.5 hours late | | | | | | | |
| 8 | 5:00 | 1848 KW | 84% | 245 | 60.1 | 1630 | 21 |
| | PM | 1955 KW | 85% | | | | |

Referring now to Table 1 above, the method of Example 2, which utilizes a refining composition comprising the lubricating additive and water, yields pulp of comparable quality to the pulp yielded by the control method, and utilizes 15% less energy in KW/hour than the control method.

It is to be understood that one or more of the values described above may vary by ±5%, ±10%, ±15%, ±20%, ±25%, ±30%, etc., so long as the variance remains within the scope of the disclosure. Moreover, all values and ranges of values, both whole and fractional, within or between each of the aforementioned values are expressly contemplated in various non-limiting embodiments. It is also to be understood that the appended claims are not limited to express any particular compounds, compositions, or methods described in the detailed description, which may vary between particular embodiments which fall within the scope of the appended claims. With respect to any Markush groups relied upon herein for describing particular features or aspects of various embodiments, it is to be appreciated that different, special, and/or unexpected results may be obtained from each member of the respective Markush group independent from all other Markush members. Each member of a Markush group may be relied upon individually and or in combination and provides adequate support for specific embodiments within the scope of the appended claims.

It is also to be understood that any ranges and subranges relied upon in describing various embodiments of the present disclosure independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present disclosure, and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims, and may be relied upon individually and/or collectively and provide adequate support for specific embodiments within the scope of the appended claims. In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 35, a subrange of from at least 10 to 25, a subrange of from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

The subject matter of all combinations of independent and dependent claims, both singly and multiply dependent, is herein expressly contemplated but is not described in detail for the sake of brevity. The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

The invention claimed is:

1. A method of increasing the throughput and/or decreasing the energy usage of a pulping process, said method comprising the steps of:

A. providing a plurality of lignocellulosic chips;

B. providing a refining composition comprising;

(i) water, wherein the water is present in the refining composition in an amount of greater than 5 wt. % based on a total weight of the refining composition, and (ii) a lubricating additive present in an amount of from 0.01 to 10 wt. % based on a total weight of the plurality of lignocellulosic chips, the lubricating additive comprising the reaction product of a sugar and an alcohol;

C. applying the refining composition to the plurality of lignocellulosic chips; and D. mechanically refining the plurality of lignocellulosic chips to form pulp;

wherein the step of applying the refining composition to the lignocellulosic chips is conducted less than 5 minutes prior to, or concurrently with, the step of mechanically refining the wood chips to form pulp, wherein the lubricating additive has the following general structure:

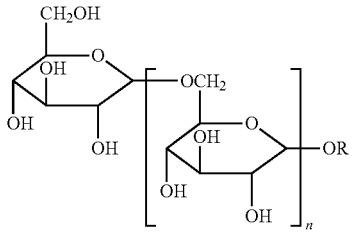

wherein n is an average value and is greater than 0 and each R is an alkyl group having from 8 to 14 carbon atoms, and wherein the average of n+1 is the degree of polymerization of the lubricating additive and is from 1.2 to 2.5.

2. A method as set forth in claim 1 wherein the sugar has the formula:

$$[C_6H_{12}O_6]_{n+1},$$

wherein n is an average value of 0, 1, 2, 3, 4, 5, 6, 7, or 8.

3. A method as set forth in claim 1 wherein the alcohol is an alkyl alcohol having the formula: ROH, wherein R is an alkyl group having 1 to 20 carbon atoms.

4. A method as set forth in claim 3 wherein the alkyl alcohol is further defined as comprising a first alkyl alcohol having the formula: ROH wherein R is an alkyl group having 1 to 20 carbon atoms, and a second alkyl alcohol, different from the first alkyl alcohol, having the formula: R'OH, wherein R' is independently an alkyl group having 1 to 20 carbon atoms.

5. A method as set forth in claim 1 wherein the lubricating additive is present in the refining composition in an amount of from 0.2 to less than 5 wt. % based on a total weight of the plurality of lignocellulosic chips.

6. A method as set forth in claim 1 wherein the water is present in the refining composition in an amount of from 50 to 99.5 wt. % based on a total weight of the refining composition.

7. A method as set forth in claim 1 wherein the refining composition has a pH of from 6 to 8.

8. A method as set forth in claim 1 wherein the refining composition consists essentially of the lubricating additive and the water.

9. A method as set forth in claim 1 wherein the step of applying the refining composition to the plurality of lignocellulosic chips is conducted no greater than 4 minutes prior to the step of mechanically refining the wood chips to form pulp.

10. A method as set forth in claim 1 wherein the step of applying the refining composition to the plurality of lignocellulosic chips is conducted simultaneous with the step of mechanically refining the wood chips to form pulp.

11. A method as set forth in claim 1 wherein the step of mechanically refining the plurality of lignocellulosic chips to form pulp comprises the steps of:

mechanically refining the plurality of lignocellulosic chips on a primary refiner; and further mechanically refining the plurality of lignocellulosic chips on a secondary refiner.

12. A method as set forth in claim 11 wherein from 25 to 100 wt. % of the total amount of refining composition applied to the plurality of lignocellulosic chips during the step of mechanically refining the plurality of lignocellulosic chips is applied in the primary refiner.

13. A method as set forth in claim 11 wherein the step of mechanically refining the plurality of lignocellulosic chips to form pulp further comprises furthermore mechanically refining the plurality of lignocellulosic chips on a tertiary refiner.

14. A method as set forth in claim 13 wherein the step of applying the refining composition to the plurality of lignocellulosic chips is further defined as applying all or a portion of the refining composition directly to the plurality of lignocellulosic chips in the primary, secondary, and/or tertiary refiners.

15. A method as set forth in claim 1 wherein the refining composition has a temperature of from 5 to 99° C. when applied to the plurality of lignocellulosic chips.

16. A method as set forth in claim 1 wherein the step of mechanically refining the plurality of lignocellulosic chips to form pulp is conducted at a rate of 1 kg/hr to 100 ton/hour.

17. A method as set forth in claim 1 wherein an energy usage during the step of refining is at least 5 percent less than a comparable energy usage during the step of refining of a comparable method that does not utilize the lubricating additive.

18. A method as set forth in claim 1 having a throughput of at least 1 percent more than a comparative throughput of a comparable method that does not utilize the lubricating additive, and an energy usage during the step of refining of equal to or less than a comparable energy usage during the step of refining of a comparable method that does not utilize the lubricating additive.

19. A method as set forth in claim 1 wherein the pulp has a Canadian Standard Freeness (CSF) of from 50 to 800 when tested in accordance with TAPPI T227, and/or a wet tensile strength of from 100 to 8,000 N/m when tested in accordance with TAPPIT494.

* * * * *